US009060908B2

(12) United States Patent
Sauser et al.

(10) Patent No.: US 9,060,908 B2
(45) Date of Patent: Jun. 23, 2015

(54) VARYING DEPTH FLUIDIZED BED

(71) Applicant: Hill-Rom Services, Inc., Batesville, IN (US)

(72) Inventors: Frank E. Sauser, Cincinnati, OH (US); Kristopher A. Klink, Indianapolis, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 14/158,017

(22) Filed: Jan. 17, 2014

(65) Prior Publication Data

US 2014/0201922 A1 Jul. 24, 2014

Related U.S. Application Data

(60) Provisional application No. 61/754,753, filed on Jan. 21, 2013.

(51) Int. Cl.

| | |
|---|---|
| ***A61G 7/057*** | (2006.01) |
| *A61G 7/012* | (2006.01) |
| *A61G 7/015* | (2006.01) |
| *A61G 7/018* | (2006.01) |
| *A61G 7/05* | (2006.01) |

(52) U.S. Cl.

CPC ..... *A61G 7/05746* (2013.01); *A61G 7/012* (2013.01); *A61G 7/015* (2013.01); *A61G 7/018* (2013.01); *A61G 7/05769* (2013.01); *A61G 2007/0514* (2013.01); *A61G 2007/0515* (2013.01); *A61G 2007/0528* (2013.01); *A61G 2007/05784* (2013.01); *A61G 2203/34* (2013.01); *A61G 2203/44* (2013.01); *A61G 2210/70* (2013.01); *A61G 2210/90* (2013.01)

(58) Field of Classification Search

CPC ..... A61G 7/05746; A61G 2007/05784; A61G 2203/34

USPC ..... 5/689, 655.4, 654, 702, 911

See application file for complete search history.

(56) References Cited

U.S. PATENT DOCUMENTS

| | | | | | |
|---|---|---|---|---|---|
| 3,428,973 | A | | 2/1969 | Hargest et al. | |
| 3,670,347 | A | | 6/1972 | Weinstein | |
| 3,760,800 | A | | 9/1973 | Staffin et al. | |
| 3,866,606 | A | | 2/1975 | Hargest | |
| 4,483,029 | A | * | 11/1984 | Paul | 5/689 |
| 4,574,785 | A | | 3/1986 | Yamamoto | |
| 4,599,755 | A | | 7/1986 | Tominaga | |
| 4,637,083 | A | | 1/1987 | Goodwin | |
| 4,642,825 | A | | 2/1987 | Kurita | |
| 4,686,723 | A | | 8/1987 | Smith | |
| 4,694,521 | A | * | 9/1987 | Tominaga | 5/689 |
| D294,638 | S | | 3/1988 | Tominaga et al. | |
| 4,776,050 | A | | 10/1988 | Goodwin | |
| 4,835,802 | A | | 6/1989 | Purcey et al. | |
| 4,879,777 | A | | 11/1989 | Goodwin | |
| 4,914,760 | A | | 4/1990 | Hargest et al. | |
| 4,967,431 | A | | 11/1990 | Hargest et al. | |
| 5,008,965 | A | | 4/1991 | Vrzalik | |
| 5,036,559 | A | * | 8/1991 | Hargest | 5/689 |
| 5,165,141 | A | | 11/1992 | Soltani | |

(Continued)

*Primary Examiner* — Robert G Santos
*Assistant Examiner* — Myles Throop
(74) *Attorney, Agent, or Firm* — Barnes & Thornburg LLP

(57) ABSTRACT

A varying depth fluidized bed comprises a tank assembly containing fluidizable medium. The tank assembly comprises at least one step such that the depth of fluidizable medium is greater in one region of the tank assembly relative to another.

20 Claims, 9 Drawing Sheets

(56) References Cited

U.S. PATENT DOCUMENTS

| | | | | |
|---|---|---|---|---|
| 5,172,781 | A | 12/1992 | Hlavinka et al. | |
| 5,235,713 | A | 8/1993 | Guthrie et al. | |
| 5,388,291 | A | 2/1995 | Roux | |
| 5,539,943 | A | 7/1996 | Romano | |
| 5,549,743 | A | 8/1996 | Pearce | |
| 5,881,409 | A | 3/1999 | Pearce | |
| 6,016,581 | A | 1/2000 | Miki | |
| 6,020,055 | A | 2/2000 | Pearce | |
| 6,073,289 | A | 6/2000 | Bolden et al. | |
| 6,192,537 | B1 | 2/2001 | Miki | |
| 6,197,099 | B1 | 3/2001 | Pearce | |
| 6,351,862 | B1 | 3/2002 | Henley et al. | |
| 6,353,948 | B1 | 3/2002 | Bolden et al. | |
| 6,574,813 | B2 | 6/2003 | Bolden et al. | |
| 6,694,555 | B2 | 2/2004 | Soltani et al. | |
| 6,721,979 | B1 | 4/2004 | Vrzalik et al. | |
| 7,797,776 | B2 | 9/2010 | Joy | |
| 7,975,337 | B2 | 7/2011 | Howell | |
| 2011/0138538 | A1* | 6/2011 | Howell | 5/689 |
| 2013/0074271 | A1* | 3/2013 | Klink et al. | 5/689 |

* cited by examiner

VARYING DEPTH FLUIDIZED BED

CROSS-REFERENCE TO RELATED APPLICATIONS

The present application claims the benefit, under 35 U.S.C. §119(e), of U.S. Provisional Application No. 61/754,753, which was filed Jan. 21, 2013, and which is hereby incorporated by reference herein in its entirety.

BACKGROUND

Providing appropriate support for patients in fluidized beds while optimizing the weight of such beds is an ongoing challenge. Fluidized beds offer improved pressure distribution for patients supported by the fluidized medium due to immersion of the patients in the fluidized medium. While several systems and methods exist to optimize fluidized beds, opportunities exist for improvement in this technology.

BRIEF SUMMARY

The present disclosure includes one or more of the features recited in the appended claims and/or the following features which, alone or in any combination, may comprise patentable subject matter.

One embodiment of a bed may comprise a first diffuser board at a first height from bottom of a tank configured to contain fluidizable medium. A second diffuser board at a second height from bottom of said tank, said second height is greater than said first height, said second diffuser board is configured to cause a predetermined pressure drop in gas flowing through it.

Another embodiment of a bed may comprise a tank assembly comprising a first diffuser board at a first height from the bottom of the tank assembly and a second diffuser board at a second height from the bottom of the tank assembly. The second height may be greater than the first height. A portion of gas that flows through the first diffuser board flows through the second diffuser board into fluidizable medium contained in the tank assembly. The fluidizable medium receives gas from both the first diffuser board and second diffuser board.

One embodiment of a varying depth tank assembly for use with a bed may comprise a first diffuser board assembly configured to supply gas to a fluidizable medium contained in the varying depth tank assembly. A second diffuser board assembly may be configured to receive gas from the first diffuser board assembly and supply gas received from the first diffuser board assembly to the fluidizable medium. At least a portion of the second diffuser board assembly may be configured to be at a different height relative to the first diffuser board assembly.

Another embodiment of a bed may comprise a tank assembly configured to contain a fluidizable medium, the tank assembly may comprise a first diffuser board assembly configured to supply gas to the fluidizable medium and a second diffuser board assembly configured to receive from the first diffuser board assembly and supply at least a portion of gas received from the first diffuser board assembly to the fluidizable medium. A head support section may be configured to variably incline with respect to the tank assembly.

One embodiment of a bed may comprise a first diffuser board assembly at a first height from the bottom of the tank assembly, the first diffuser board assembly may be configured to supply gas to a fluidizable medium contained in the tank assembly. A second diffuser board assembly at a second height from the bottom of the tank assembly, wherein the second height is greater than the first height. Said second diffuser board assembly is configured such that drop in pressure of gas flowing across it is configured to match pressure drop in the fluidizable medium commensurate to difference between the second height and the first height.

Another embodiment of a bed may comprise means for supplying gas to a fluidizable medium contained in a tank assembly at a first height and a second height from bottom of the tank assembly, gas supplied to the fluidizable medium at the second height comprises a portion of gas supplied at the first height.

One embodiment of a bed may comprise a first diffuser board at a first height from bottom of a tank configured to contain fluidizable medium. A second diffuser board at a second height from bottom of said tank, said second height is greater than said first height, pressure drop in gas flowing through said second diffuser board is configured to be substantially linearly related to gas flow rate through it.

BRIEF DESCRIPTION OF DRAWINGS

The accompanying drawings incorporated in and forming a part of the specification illustrate several aspects of the claimed subject matter and, together with the description, serve to explain the principles of the claimed subject matter. In the drawings:

DETAILED DESCRIPTION OF ILLUSTRATIVE EMBODIMENTS

Figure 1:
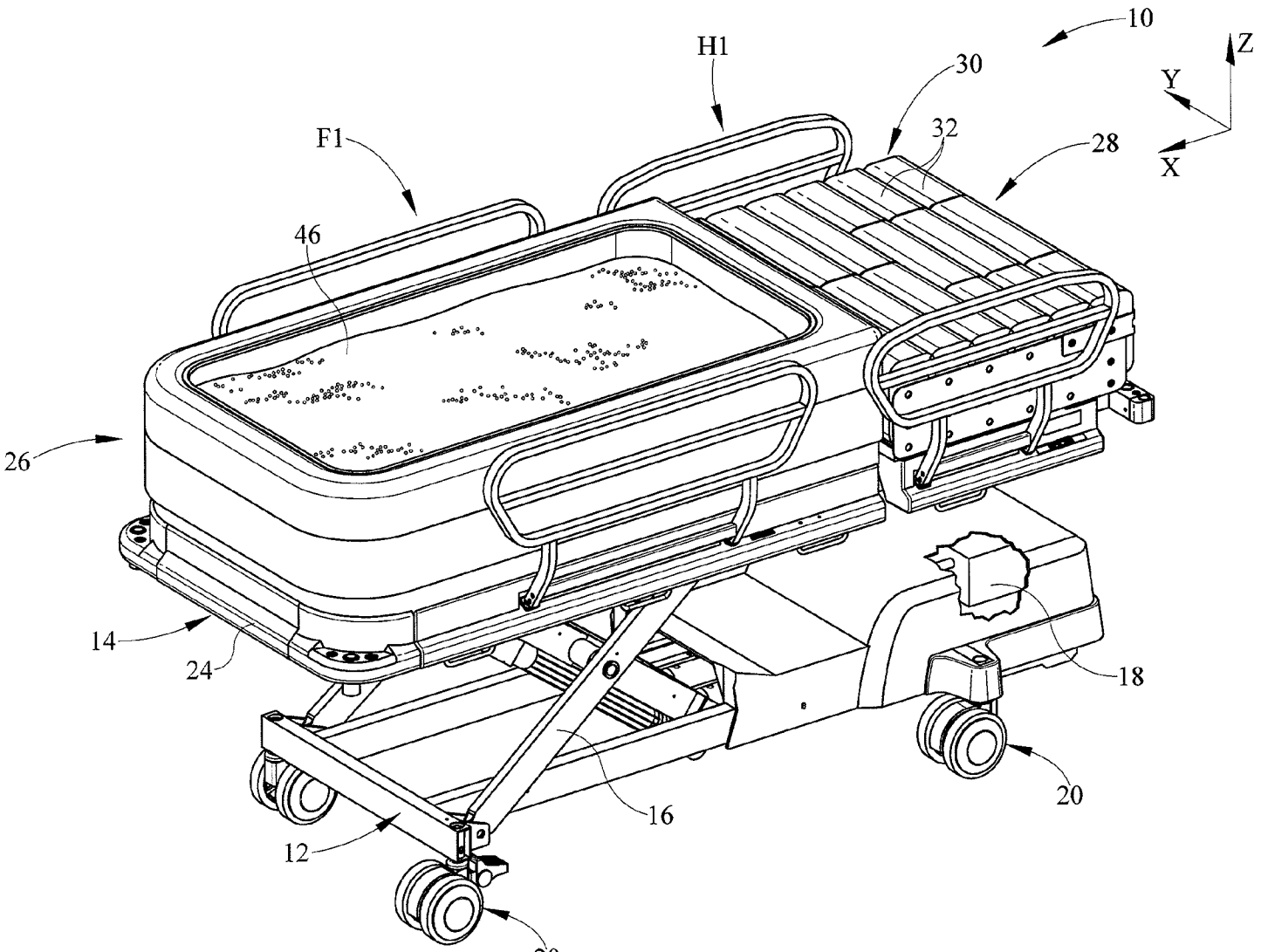
FIG. 1 is a perspective view of one embodiment of a person support apparatus, constructed according to one or more of the principles disclosed herein.

The embodiments of the claimed subject matter and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be briefly mentioned or omitted so as to not unnecessarily obscure the embodiments of the claimed subject matter described. The examples used herein are intended merely to facilitate an understanding of ways in which the claimed subject matter may be practiced and to further enable those of skill in the art to practice the embodiments of the claimed subject matter described herein. Accordingly, the examples and embodiments herein are merely illustrative and should not be construed as limiting the scope of the claimed subject matter, which is defined solely by the appended claims and applicable law. Moreover, it is noted that like reference numerals represent similar parts throughout the several views of the drawings.

It is understood that the subject matter claimed is not limited to the particular methodology, protocols, devices, apparatus, materials, applications, etc., described herein, as these may vary. It is also to be understood that the terminology used herein is used for the purpose of describing particular embodiments only, and is not intended to limit the scope of the claimed subject matter.

Unless defined otherwise, all technical and scientific terms used herein have the same meanings as commonly understood by one of ordinary skill in the art.

The subject matter herein is directed to systems and methods of use related to a fluidized bed. Air fluidized beds are typically used in healthcare settings and at home to provide support to patients that require an enhanced degree of care to relieve pressure on frequently loaded areas of the patient's body.

A person support apparatus 10 according to one illustrative embodiment of the current disclosure is shown in FIG. 1. The person support apparatus 10 is a fluidized bed and includes a head section H1, where the head of a person (not shown) can be positioned, and a foot section F1, where the feet of a person (not shown) can be positioned. The person support apparatus 10 includes a lower frame 12, an upper frame 14, and a plurality of supports 16 supporting the upper frame 14 on the lower frame 12.

Figure 2:
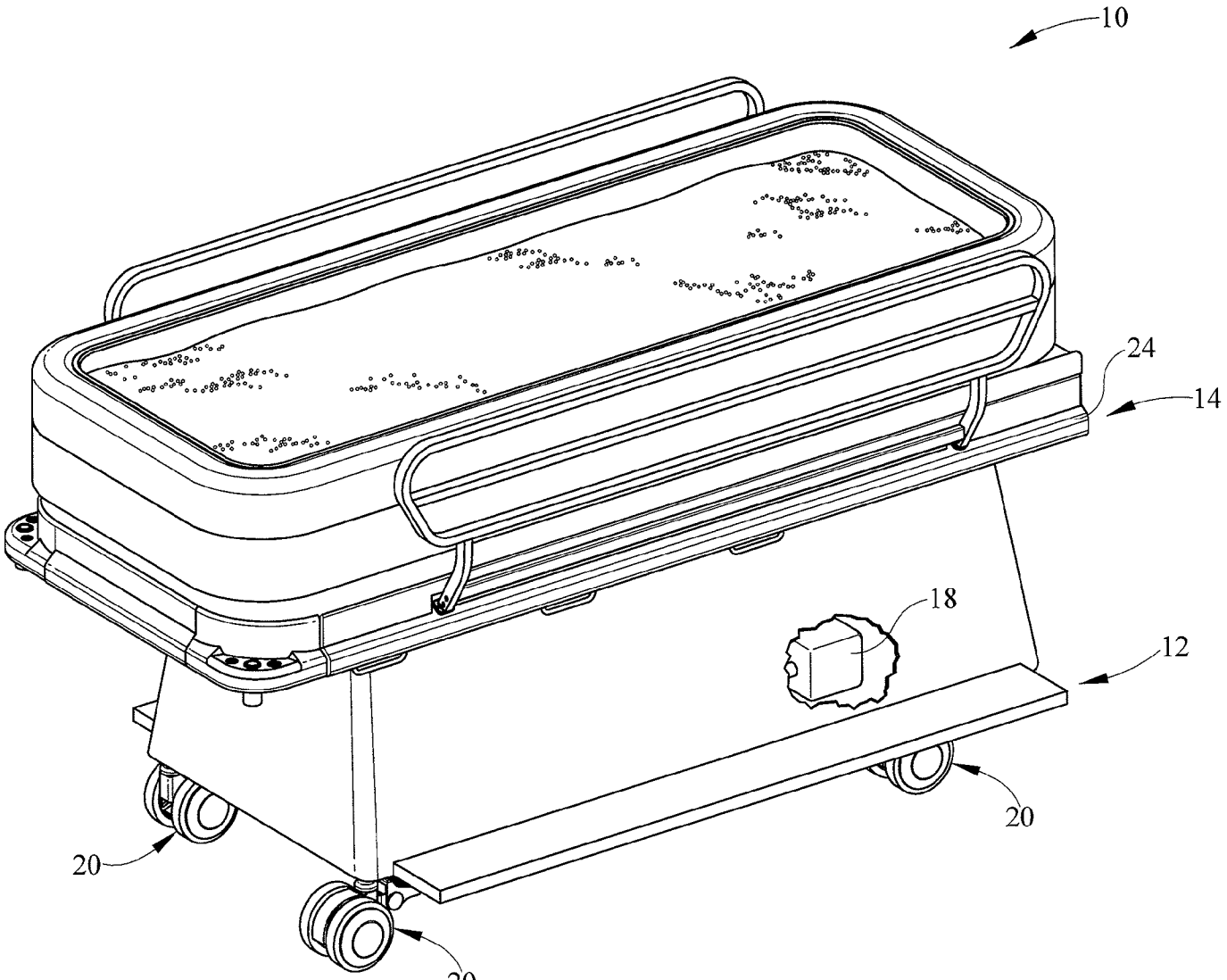
FIG. 2 is a perspective view of another embodiment of a person support apparatus, constructed according to one or more of the principles disclosed herein.

The supports 16 are coupled to the lower frame 12 and the upper frame 14 and movably support the upper frame 14 above the lower frame 12 as shown in FIG. 1. In one illustrative embodiment, the supports 16 are actuated by a Hi/Lo actuator 18 that causes the supports 16 to raise and/or lower the upper frame 14 with respect to the lower frame 12. In another embodiment, the supports 16 fixedly support the upper frame 14 above the lower frame 12 as shown in FIG. 2. In the embodiments shown in FIGS. 1 & 2 the lower frame is supported by wheels 20 to help with transport of the person support apparatus 10.

Figure 5B:
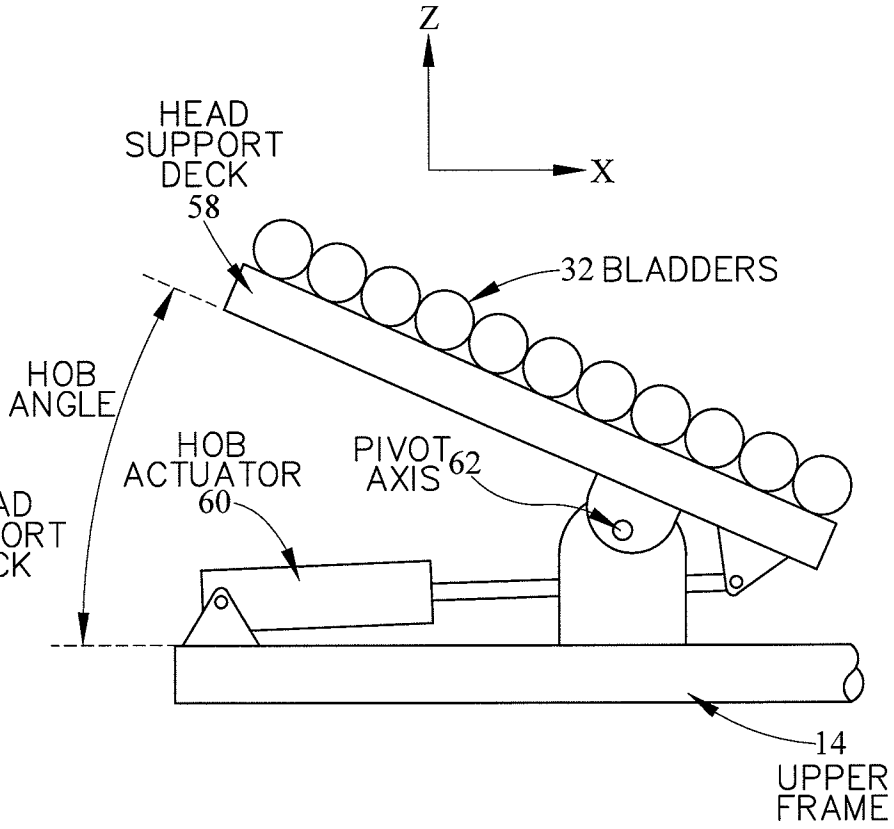
FIGS. 5A & 5B are cross-sectional views of head support section portion of a person support apparatus, constructed according to one or more of the principles disclosed herein.
Figure 5A:
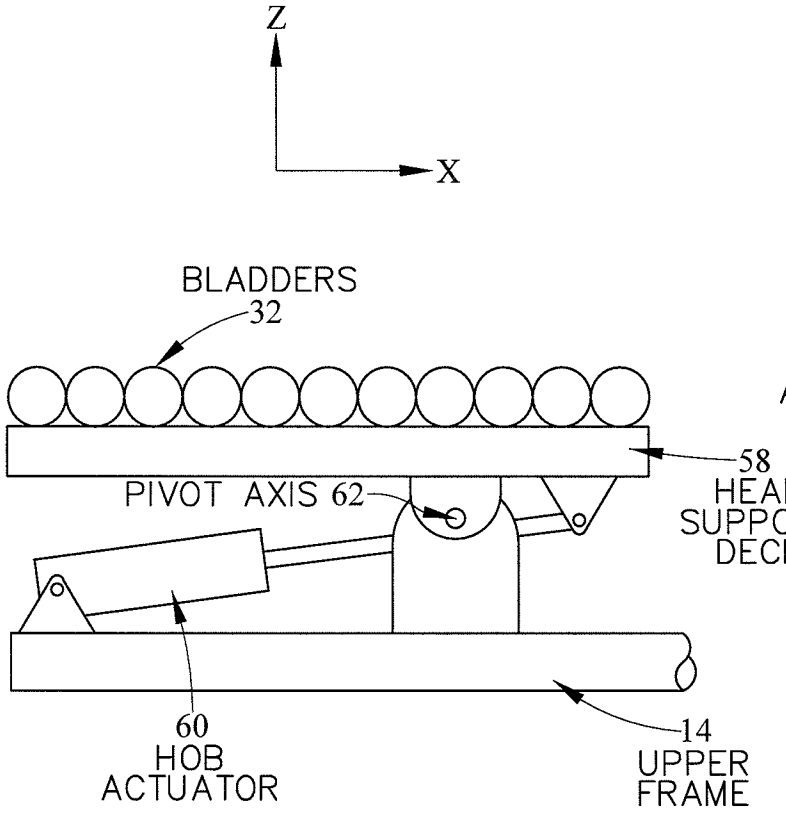

The upper frame 14 includes an upper frame weldment 24 that supports a tank assembly 26 and a head end support assembly 28 as shown in FIG. 1. In one contemplated embodiment, the upper frame 14 does not include a head end support assembly 28 and instead, the tank assembly 26 that extends the length of the upper frame 14 as shown in FIG. 2. The head end support assembly 28 is configured to support a person's head and/or torso while the tank assembly 26 is configured to support the pelvic region and lower extremities of a person. The head end support assembly 28 includes a person support surface 30 or mattress 30 composed of fluid bladders 32 in this embodiment. In the embodiment shown in FIG. 1 the head end support assembly 28 is configured to variably incline with respect to the tank assembly 26 to move a person supported on the person support apparatus 10 between a substantially horizontal position and a reclined or elevated position by varying the Head of Bead (HOB) angle as shown in FIGS. 5A and 5B. In another embodiment the person support surface 30 includes foam (not shown) and/or a combination of foam and fluid bladders 32. A co-ordinate system is disclosed in FIG. 1 to assist in description of relative positions and motions. As shown, X axis is configured to pass through the middle of the person support apparatus 10 longitudinally. Axis Y is orthogonal to the X axis such that the X-Y plane is substantially parallel to the floor. Axis Z is orthogonal to the X-Y plane.

Embodiments of fluidized person support systems are found in U.S. Pat. Nos. 7,975,337, 4,967,431, 4,483,029 and in U.S. patent application Ser. Nos. 12/634,934 and 13/246,886, all of which are hereby incorporated by reference herein.

Figure 3:
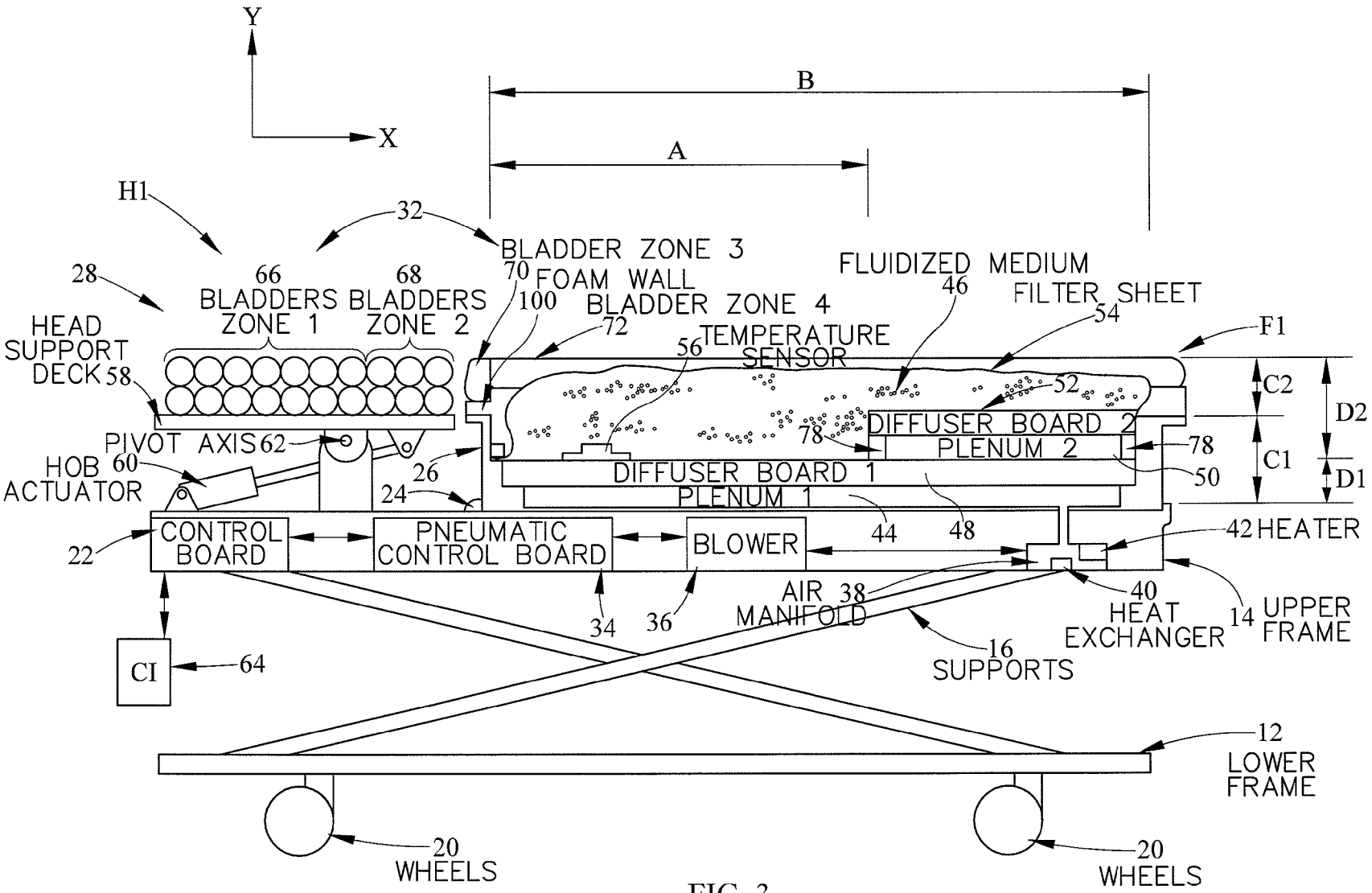
FIG. 3 is a cross-sectional side view of one embodiment of a person support apparatus, constructed according to one or more of the principles disclosed herein.

FIG. 3 is a cross-sectional side view showing some elements of one embodiment of a fluidized person support apparatus 10. The upper frame 14 in the embodiment of FIG. 3 houses a control board 22, a pneumatic control board 34, a blower 36, an air manifold 38, a heat exchanger 40 and a heater 42. A control interface (CI) 64 is configured to communicate with the control board 22 allowing a user to initiate and/or stop fluidization therapy. In other embodiments any one or combination of a control board 22, a pneumatic control board 34, a blower 36, an air manifold 38, a heat exchanger 40 and/or heater 42 may be mounted on other portions of the person support apparatus including but not limited to the lower frame 12, side rails (not shown) and/or supports 16. The upper frame 14 supports an upper frame weldment 24 configured to locate a tank assembly 26 in this embodiment. In another embodiment the tank assembly 26 is located and/or supported directly by the upper frame 14. The tank assembly comprises a first plenum 44 which receives gas from the air manifold 38 in this assembly. In this embodiment the air manifold 38 supplies air to the first plenum 44 while in other embodiments the air manifold 38 supplies any combination of gases to the first plenum 44. Air from the first plenum 44 is configured to flow through a first diffuser board 48 and into a fluidizable medium 46 contained in the tank assembly 26 for portion A shown in FIG. 3. Second diffuser board support 78 structurally supports a second diffuser board 52 and is in turn structurally supported by the first diffuser board 48 in this embodiment. In other embodiments the second diffuser board support 78 is mechanically connected to the wall of the tank assembly 26 so that the second diffuser board 52 is structurally supported by the wall of the tank assembly 26. In the embodiment shown in FIG. 3 the second diffuser board support 78 also serves to restrict flow of gas through it into the fluidizable medium 46. The second diffuser board support 78 allows the formation of a second plenum 50 between the second diffuser board 52 and the first diffuser board 48. In this embodiment air flowing into the second plenum 50 and out of the second diffuser board 52 into the fluidizable medium 46 is supplied through the first diffuser board 48. In another embodiment another air supply line (not shown) supplies air to the second plenum 50 in addition to the air received by the second plenum 50 from the first diffuser board 48. In this embodiment the second diffuser board 52 is of length B−A wherein length B signifies the length of the tank assembly containing fluidizable medium and length A signifies the length of the first diffuser board 48 directly supplying gas to the fluidizable medium 46. In this embodiment the first diffuser board 48 is at a height D1 from the bottom of the tank assembly and the second diffuser board 52 is at a height C1 from the bottom of the tank assembly such that C1 is greater than D1. In this embodiment the height of the second diffuser board 52 is a discrete offset C1–D1 from the height of the diffuser board while in another embodiment the elevation of the second diffuser board 52 gradually increases in elevation with respect to the first diffuser board 48.

The fluidizable medium 46 comprises glass beads in this embodiment while in another embodiment the beads are made of polymeric material and/or any combination of glass and polymeric materials in yet another embodiment. In this embodiment the beads vary in size from 50-150 micrometers. In other embodiments the fluidizable medium 46 may comprise particles of any shape and material. The fluidizable medium 46 is configured to support at least a portion of a patient, in the embodiment shown in FIG. 3 the fluidizable medium 46 is configured to support the trunk and leg regions of a patient. Since the trunk section of a patient is typically heavier than the legs, a greater bead depth D2 in the trunk support region of the tank assembly (zone A) allows immersion of the patient while minimizing the potential of the patient bottoming out and resting on the first diffuser board 48. The legs of patient supported by the fluidizable medium 46 (zone B) typically require a smaller column of fluidizable medium (zone B–A) for support since human leg portions typically weigh less relative to the trunk portion and column C2 of fluidizable medium serves the purpose. Optimizing the height of the column of fluidizable medium available for support of various portions of the body allows a greater column of fluidizable medium available for support of heavier portions of the patient's body thereby allowing support of heavier patients with a given volume of fluidizable medium 46 and/or reducing the volume (therefore weight) of fluidizable medium 46 needed.

The pressure drop across the second diffuser board 52 is designed such that it is substantially equal to the drop in pressure in the fluidizable medium between the height of the first diffuser board 48 and the second diffuser board 52 (C1–D1, in inches). In one embodiment the pressure drop across the second diffuser board 52 ($A_{Pdiffuser_board}$, in inches of water—IOW) is linearly related to the flow rate of gas (F, in cubic feet per minute—CFM) through it and described by Equation 1 below while in other embodiments the pressure drop across the second diffuser board 52 may be non-linearly related to the flow rate of gas (F, in CFM) through it.

$$AP_{diffuser_board}=A\times F+B \qquad \text{Equation 1}$$

In Equation 1 above, A and B are constants that depend on the material properties and cross-sectional geometry of the second diffuser board 52 through which gas passes. In one exemplary embodiment A is substantially 0.0881 and B is substantially −0.1183. In other embodiments any other material and/or geometry of the second diffuser board 52 may be selected to achieve a desired pressure drop. In other embodiments the material and/or cross-sectional geometry of the first diffuser board 48 may be different relative to that of the second diffuser board 52. In other embodiments the relationship between $A_{Pdiffuser_board}$ and F may be non-linear and/or described in a tabular form containing discrete corresponding values of $A_{Pdiffuser_board}$ and F.

The pressure drop in the fluidizable medium 46 between height D1 and C1 is described by Equation 2 below wherein A $P_{unit\ height}$ represents difference in pressure (in IOW) for unit height (one inch in this embodiment) in the fluidizable medium. In one exemplary embodiment A $P_{unit\ height}$ is substantially 1.4 inches of water.

$$AP_{C1-D1}=AP_{unit\ height}\times(C1-D1) \qquad \text{Equation 2}$$

Since the pressure drop across the second diffuser board 52 is configured to be substantially equal to the pressure drop in the fluidizable medium 46 between C1 and D1, Equation 1 and Equation 2 are equated in Equations 3 & 4.

$$\Delta P_{C1-D1}=\ddot{A}P_{diffuser_board} \qquad \text{Equation 3}$$

$$A\times F+B=\ddot{A}P_{unit\ height}\times(C1-D1) \qquad \text{Equation 4}$$

Equation 4 above allows adjustment of the flow rate (F) through the second diffuser board 52 based on step height (C1–D1) and vice-versa.

The fluidizable medium 46 is contained in the tank assembly 26 by a gas permeable filter sheet 54. The filter sheet 54 comprises perforations less than 30 micrometers in this embodiment such that the perforations do not allow beads to pass through. In another embodiment the perforations in the filter sheet 54 may be of any size such that the perforations do not allow beads to pass through.

The tank assembly 26 in the embodiment shown in FIG. 3 comprises a foam wall 100 upon which at least one layer of bladders 70 & 72 are mounted. The lower foam wall 100 provides structural rigidity and minimizes bulging of the tank assembly 26 when a person is supported by the column of fluidizable medium 46. In another embodiment the tank assembly 46 is lined with bladders which are inflated to different pressures. A head support deck 58 is configured to be variably inclined with respect to the tank assembly 26 about a pivot axis 62. The head support deck 58 is actuated by a HOB actuator 60 as shown in FIG. 3. The head support deck 58 supports bladders 66 and 68 in this embodiment configured to support the upper body of a person thereon.

Figure 4:
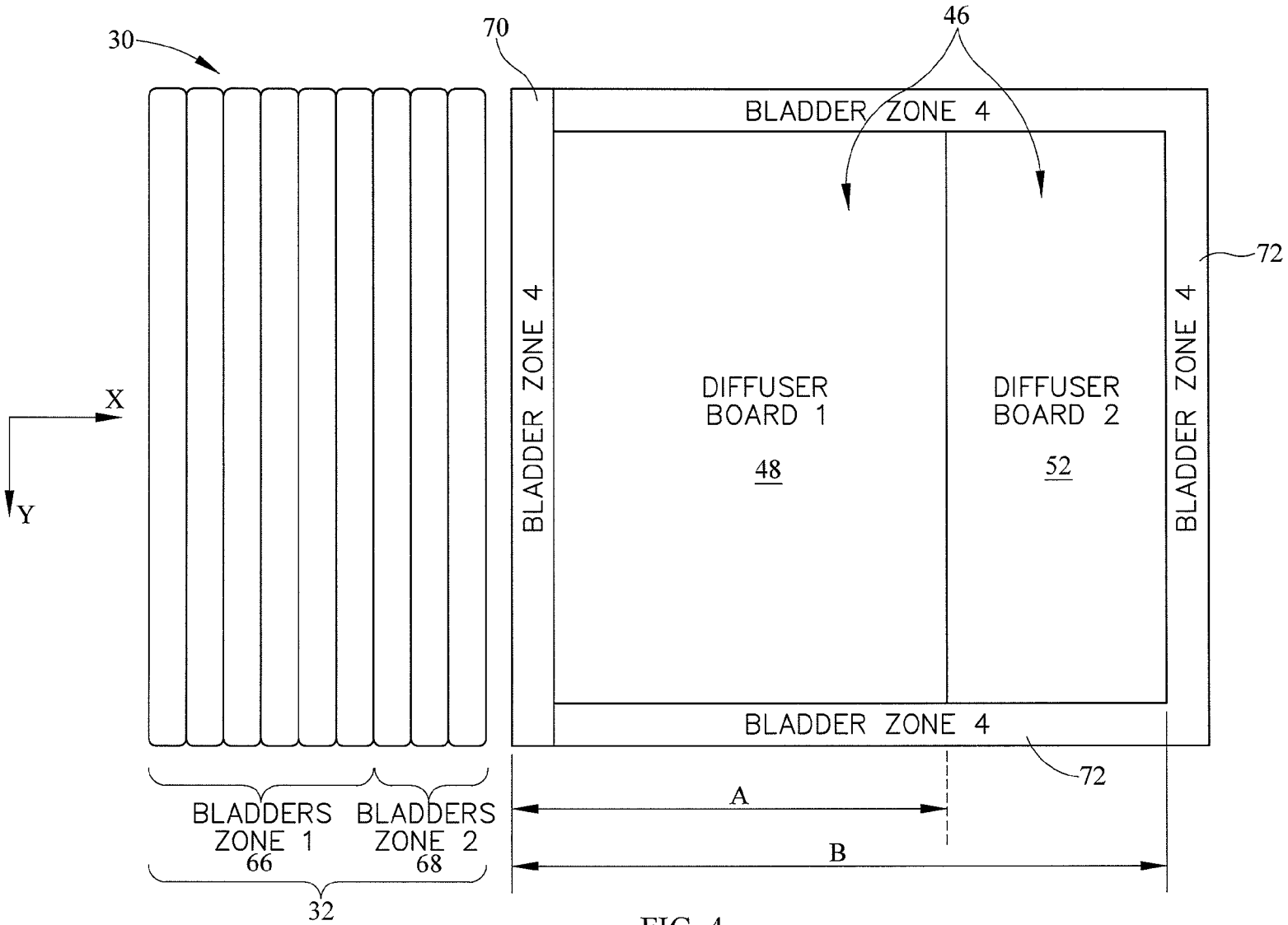
FIG. 4 is a plan view showing some components of the person support apparatus shown in FIG. 3, constructed according to one or more of the principles disclosed herein.

FIG. 4 is a plan view showing some components of the person support apparatus shown in FIG. 3. In this embodiment a first bladder zone 66 and a second bladder zone 68 rest on top of the head support deck 58. The first bladder zone 66 and second bladder zone 68 allow individual pressurize adjustments for support of the head and lumbar regions respectively. In other embodiments any number of bladders may be mounted on top of the head support deck 58 with individual pressure adjustment for each or any combination of bladders. In the embodiment shown in FIG. 4 a third bladder zone 70 and a fourth bladder zone 72 indicate individual pressure adjustment capability of bladders in lumbar support region and the rest of the sidewalls of the tank assembly.

FIGS. 5A & 5B are cross-sectional views of head support section portion of one embodiment of a person support apparatus. The HOB actuator 60 shown in these figures is connected by a hinge connection to the upper frame 14 at one end and the head support deck 58 at the other end. The head support deck 58 is connected to the upper frame 14 with a hinge connection about a pivot axis 62 in the embodiment shown in FIGS. 5A & 5B. As the HOB actuator 60 actuates it causes the head support deck 58 to incline with respect to the upper frame 14 by causing the rotation of the head support deck 58 with respect to the upper frame 14 about the pivot axis 62 as shown in FIG. 5B. The inclination of the head support deck 58 with respect to the upper frame 14 is shown as the Head of Bed (HOB) Angle in FIG. 5B. In this embodiment the HOB actuator 60 is a pneumatic actuator, while in other embodiments the HOB actuator may be any combination of electrical, pneumatic, hydraulic and mechanical systems.

Figure 6C:
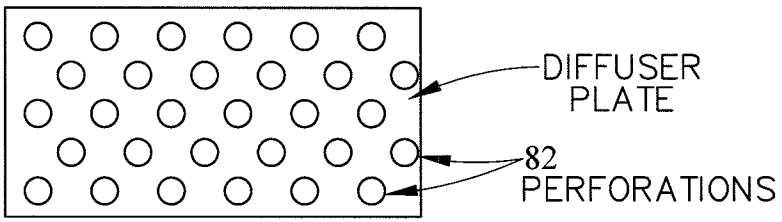
FIGS. 6A & 6B are depictions of two embodiments of a stepped tank assembly for use in a person support apparatus, constructed according to one or more of the principles disclosed herein.
Figure 6B:
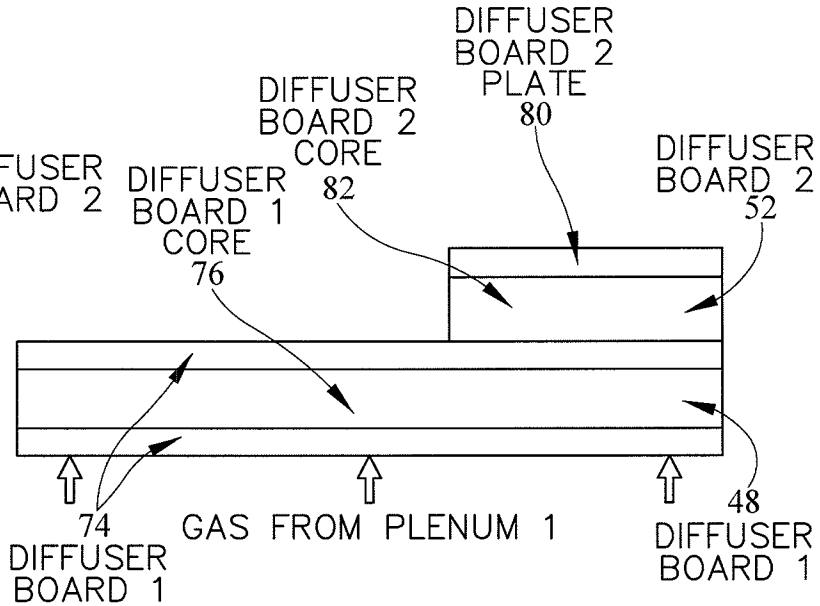
Figure 6A:
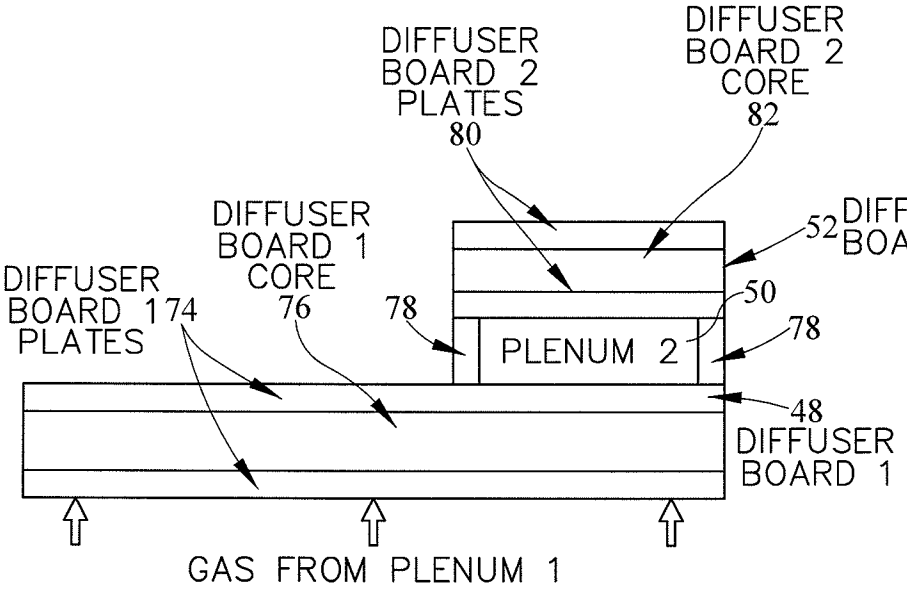

FIGS. 6A & 6B are depictions of two embodiments of a stepped tank assembly for use in a person support apparatus 10. In the embodiment shown in FIG. 6A the first diffuser board 48 comprises a first diffuser board core 76 sandwiched between the first diffuser board plates 74. In this embodiment the first diffuser board core 76 is made of a porous polymeric material, one exemplary embodiment of which is POREX® plastics. In other embodiments any other material or combination of materials permeable to gas may be selected. In the embodiment shown in FIG. 6A a second diffuser board 52 is offset from the first diffuser board 48 by a second diffuser board support 78. The second diffuser board support 78 is made of a gas impermeable material in this embodiment and allows formation of a second plenum 50 between the first diffuser board 48 and the second diffuser board 52. In the embodiment shown in FIG. 6A the second diffuser board comprises a second diffuser board core 82 sandwiched between the second diffuser board plates 80. In this embodiment the second diffuser board core 82 is made of a porous polymeric material, one exemplary embodiment of which is POREX® plastics. In other embodiments any other material permeable to gas may be selected.

In the embodiment shown in FIG. 6B the second diffuser board 52 rests directly on top of the first diffuser board 48. There is no second plenum 50, in the embodiment shown on FIG. 6B. In other embodiments, one or more components of the first diffuser board 48 and/or the second diffuser board 52 may be sculpted to form a second plenum 50 between the second diffuser board 52 and the first diffuser board 48. In the embodiments shown in FIG. 6B, the second diffuser board 48 comprises a second diffuser board core 82 and one second diffuser board plate 80. In another embodiment the second diffuser board 52 comprises second diffuser board plates 80 sandwiching the second diffuser board core 82 as shown in FIG. 6A.

In other embodiments the first diffuser board 48 and/or the second diffuser board 52 may comprise only the first diffuser board core 76 and the second diffuser board core 82 without diffuser board plates.

FIG. 6C shows a section of one embodiment a diffuser board plate for use as part of the first diffuser board 48 and/or the second diffuser board 52. The diffuser plate shown in FIG. 6C is made of metal and includes perforations as seen. In one exemplary embodiment the perforations in the diffuser plate are 6.35 mm diameter holes on 9.52 mm centers and are 40% open, the holes are arranged in a staggered pattern. In another embodiment the perforations in the diffuser plates may be of any size and pattern. In the embodiments shown in FIGS. 6A, 6B and 6C the diffuser board cores are gas permeable and bead impermeable while the diffuser board plates are gas and bead permeable. In other embodiments the diffuser board plates may be gas permeable and bead impermeable, in one embodiment by selection of appropriate size of perforations in the diffuser board plates.

Figure 7:
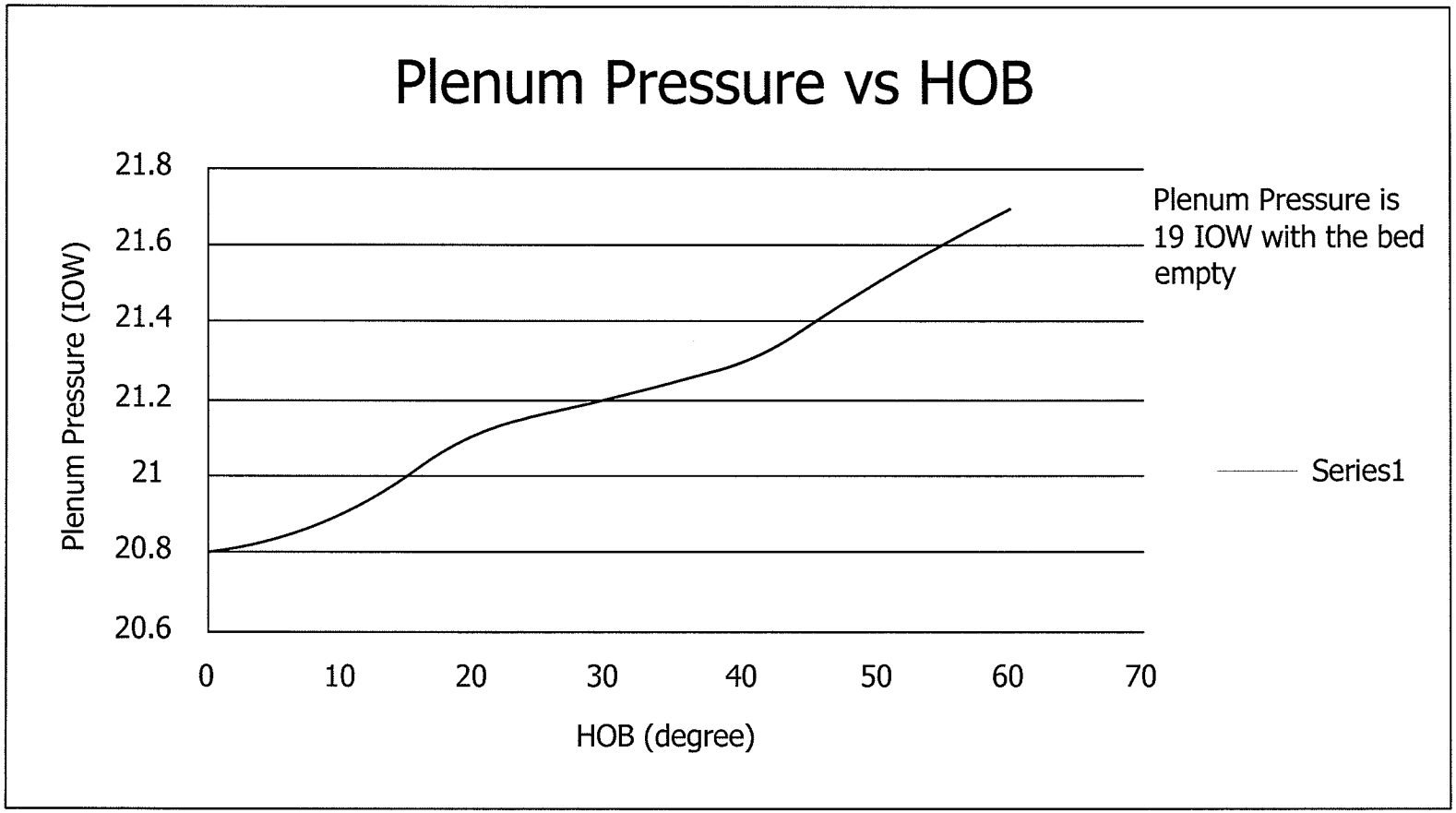
FIG. 7 is a graphical representation of variation in plenum pressure with respect to variation in Head of Bed Angle in one embodiment of a person support apparatus, constructed according to one or more of the principles disclosed herein.

FIG. 7 is a graphical representation of variation in plenum pressure with respect to variation in Head of Bed Angle in one exemplary embodiment of a person support apparatus 10 in accordance with Table 1 below. The plenum pressure for an empty bed (when a person is not being supported) is 19 IOW in this exemplary embodiment. The variation in plenum pressure (in IOW) versus HOB angle (in degrees) is representative of these readings for a 180 lbf male subject supported by the person support apparatus in one exemplary embodiment.

TABLE 1

| HOB Angle (Degrees) | Plenum Pressure (IOW) |
|---|---|
| 0 | 20.8 |
| 10 | 20.9 |
| 20 | 21.1 |

TABLE 1-continued

| HOB Angle (Degrees) | Plenum Pressure (IOW) |
|---|---|
| 30 | 21.2 |
| 40 | 21.3 |
| 50 | 21.5 |
| 60 | 21.7 |

Figure 8:
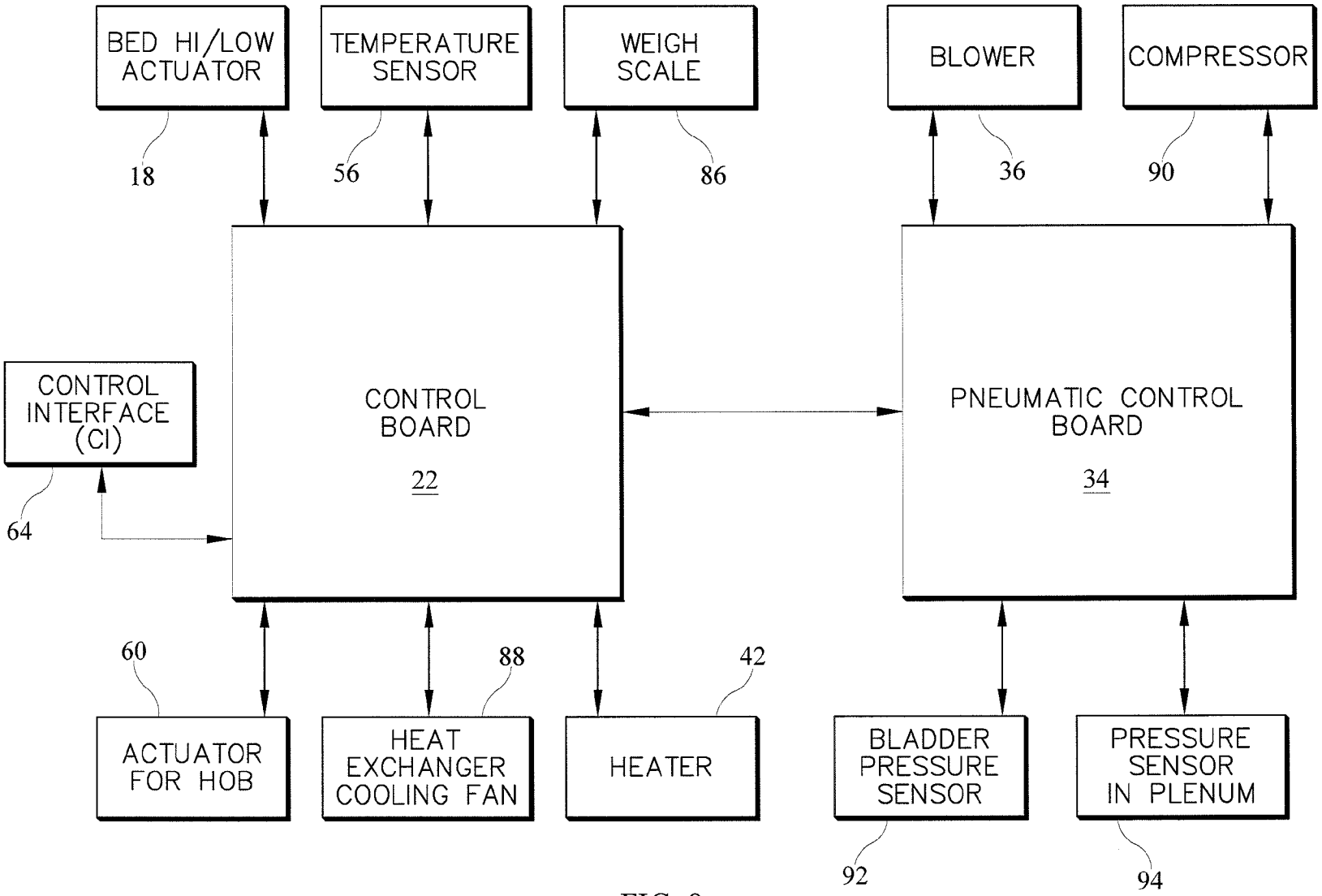
FIG. 8 is a block diagram showing some elements of one embodiment of a person support apparatus, constructed according to one or more of the principles disclosed herein.

FIG. 8 depicts a block diagram showing some elements of one embodiment of a person support apparatus 10. A control interface (CI) 64 is configured to communicate with the control board 22 as shown. The CI 64 is a touch screen device configured to allow a caregiver to initiate and stop fluidized therapy in this embodiment. In other embodiments the CI 64 may utilize any of or combinations of touch screen technology, graphical display and mechanical buttons. The control board 22 is configured to receive signals from the Hi/Lo actuator 18, at least one temperature sensor 56 and at least one weigh scale 86 in the embodiment shown. As shown in FIG. 3 in one embodiment at least one temperature sensor 56 monitors the temperature of the fluidized medium 46. In other embodiments one or more temperature sensors may monitor the temperature of the ambient air, the temperature of gas supplied to the first plenum 44 and the heater 42 temperature. In this embodiment at least one weigh scale 86 provides a reading for the load acting on it and the control board 22 in configured to discern the weight of a person supported by the person support apparatus 10 by zeroing out the weight of the person support apparatus structure acting on the weigh scale. In one embodiment a caregiver has the ability to zero the weigh scale reading by inputting a control signal via the CI 64. The control board 22 is configured to also communicate with the HOB actuator 60, at least one heat exchanger fan 88 and heater 42 in the embodiment shown. As shown in FIG. 8 the control board 22 is configured to communicate with a pneumatic control board 34. In this embodiment the pneumatic control board 34 is configured to control blower 36, compressor 90, bladder pressure sensor 92 and plenum pressure sensor 94. In the embodiment shown in FIG. 8 the pneumatic control board 34 is a separate structure while in other embodiments one or all of the components connected to the pneumatic control board 34 are connected to the control board 22 while controls all the components. The components shown in FIG. 8 may be mounted anywhere on the person support apparatus 10 including but not limited to the lower frame 12, upper frame 14, supports 16, side rails, tank assembly 26 and head support deck 58. In one embodiment the person support apparatus may comprise a head board and/or foot board to which any one of the components shown in FIG. 8 may be mounted.

Figure 9:
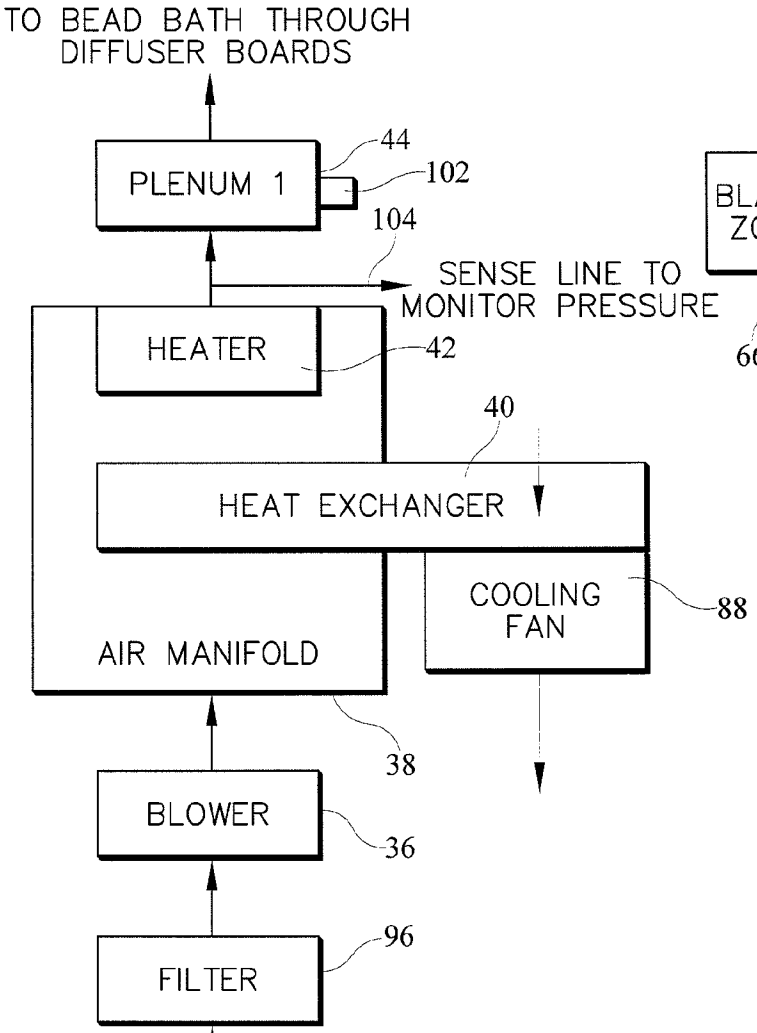
FIG. 9 is a block diagram showing elements of a system supplying air to a fluidized medium in one embodiment of a person support apparatus, constructed according to one or more of the principles disclosed herein.

FIG. 9 depicts a block diagram showing elements of a system supplying air to a fluidized medium 46 in one embodiment of a person support apparatus 10. A filter 96 is configured to prevent particulate matter over a predetermined size along with ambient air to enter the blower 36. The blower 36 supplies air to the air manifold 38. In this embodiment the air manifold comprises a heater 42 configured to heat the air supplied by the blower 36 and a heat exchanger 40 configured to dissipate heat from the air supplied by the blower 40. In this embodiment a heat exchanger cooling fan 88 is configured to enhance air flow over a portion of the heat exchanger 40 to dissipate heat. In one embodiment the air manifold structure serves as the heat exchanger 40. The control board 22 is configured to control the heater 42 and heat exchanger cooling fan 88 to vary the temperature of the fluidizable medium 46 bath. As shown in FIG. 9 air from the air manifold 38 flows into the first plenum 44. In this embodiment a pressure sense line 104 is configured to communicate a signal indicative of the pressure of gas entering the first plenum 44 to the pneumatic control board 34. A pressure tap 102 is configured to communicate a signal indicative of plenum pressure in the first plenum 44 to the pneumatic control board 34. FIG. 7 shows graphical representation of variation of this plenum pressure with respect to variation in Head of Bed Angle in one exemplary embodiment.

Figure 10:
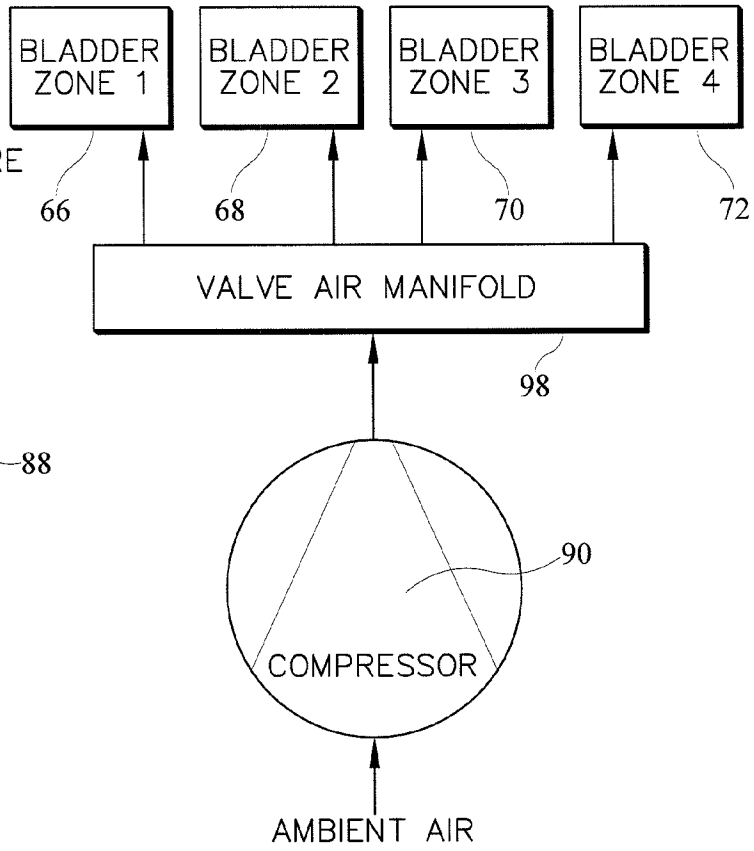
FIG. 10 is a block diagram showing elements of a system supplying air to bladders in one embodiment of a fluidized person support apparatus, constructed according to one or more of the principles disclosed herein.

FIG. 10 shows a block diagram showing elements of a system supplying air to bladders in one embodiment of a fluidized person support apparatus 10. A compressor 90 receives ambient air and supplies pressurized air to bladder zones (66, 68, 70 & 72) via a valve air manifold 98. Although not shown in FIG. 10 one or more of the bladders include a bladder pressure sensor 92 to provide a signal indicative of pressure in the bladder. In another embodiment one or more of the bladders comprise a pressure sense line which communicates a signal indicative of the pressure in the bladder to the pneumatic control board 34.

In the embodiment shown in FIGS. 9 &10 the fluid supplies supplying gas to the fluidizable medium 46 and the bladders are distinct, in other embodiments one fluid supply (a blower, fan, compressor or any other device) supplies gas to both the fluidizable bead bath and the bladders.

Any other methods of use may be adopted by the user in other embodiments.

The use of the terms "a" and "an" and "the" and similar referents in the context of describing the subject matter (particularly in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. Furthermore, the foregoing description is for the purpose of illustration only, and not for the purpose of limitation, as the scope of protection sought is defined by the claims as set forth hereinafter together with any equivalents thereof entitled to. The use of any and all examples, or exemplary language (e.g., "such as") provided herein, is intended merely to better illustrate the subject matter and does not pose a limitation on the scope of the subject matter unless otherwise claimed. The use of the term "based on" and other like phrases indicating a condition for bringing about a result, both in the claims and in the written description, is not intended to foreclose any other conditions that bring about that result. No language in the specification should be construed as indicating any non-claimed element as essential to the practice of the invention as claimed.

Preferred embodiments are described herein, including the best mode known to the inventor for carrying out the claimed subject matter. Of course, variations of those preferred embodiments will become apparent to those of ordinary skill in the art upon reading the foregoing description. The inventor expects skilled artisans to employ such variations as appropriate, and the inventor intends for the claimed subject matter to be practiced otherwise than as specifically described herein. Accordingly, this claimed subject matter includes all modifications and equivalents of the subject matter recited in the claims appended hereto as permitted by applicable law. Moreover, any combination of the above-described elements in all possible variations thereof is encompassed unless otherwise indicated herein or otherwise clearly contradicted by context.

The disclosures of any references and publications cited above are expressly incorporated by reference in their entireties to the same extent as if each were incorporated by reference individually.

The invention claimed is:

1. A bed comprising:

a tank assembly comprising a first diffuser board at a first height from a bottom of said tank assembly and a second diffuser board at a second height from the bottom of said tank assembly, said second height is greater than said first height, a portion of gas flowing through said first diffuser board flows through said second diffuser board into fluidizable medium contained by said tank assembly, said fluidizable medium receives gas from said first diffuser board and said second diffuser board, wherein said first diffuser board is substantially parallel with, and spaced from, said second diffuser board.

2. The bed of claim 1 further comprising a first plenum and a second plenum, said second plenum configured to receive gas flowing from said first plenum through said first diffuser board, said second plenum configured to supply gas to said second diffuser board.

3. The bed of claim 2 wherein, at substantially the same height from the bottom of said tank assembly, gas exiting said second plenum is configured to be at substantially the same pressure as gas exiting said first plenum.

4. The bed of claim 1 further comprising a head support assembly configured to variably incline with respect to said tank assembly.

5. The bed of claim 1 wherein said second diffuser board is structurally supported by said first diffuser board.

6. The bed of claim 1 wherein pressure drop in gas flowing through said second diffuser board is related to gas flow rate through it.

7. A varying depth tank assembly for use with a bed, comprising:

a first diffuser board assembly configured to supply gas to a fluidizable medium contained in said varying depth tank assembly; and a second diffuser board assembly is configured to receive gas from said first diffuser board assembly and supply gas received from said first diffuser board assembly to said fluidizable medium, at least a portion of said second diffuser board assembly is configured to be at a different height relative to said first diffuser board assembly, wherein said first diffuser board assembly is substantially parallel with, and spaced from, said second diffuser board assembly.

8. The varying depth tank assembly of claim 7 wherein said first diffuser board assembly comprises a polymeric diffuser board core sandwiched between diffuser board plates.

9. The varying depth tank assembly of claim 7 further comprising a plenum configured to supply gas to said first diffuser board assembly.

10. The varying depth tank assembly of claim 7 further comprising a plenum configured to receive gas from said first diffuser board assembly and supply gas to said second diffuser board assembly.

11. The varying depth tank assembly of claim 7 wherein pressure drop in gas flowing through said second diffuser board assembly is related to gas flow rate through it.

12. A fluidized bed comprising:

a tank assembly configured to contain a fluidizable medium, said tank assembly comprising a first diffuser board assembly configured to supply gas to said fluidizable medium and a second diffuser board assembly configured to receive gas from said first diffuser board assembly and supply at least a portion of gas received from said first diffuser board assembly to said fluidizable medium, wherein said first diffuser board assembly is substantially parallel with, and spaced from, said second diffuser board assembly; and a head support section configured to variably incline with respect to said tank assembly.

13. The fluidized bed of claim 12 further comprising at least one bladder configured to be mounted on top of said head support section.

14. The fluidized bed of claim 13 further comprising a compressor, wherein said compressor is configured to inflate said at least one bladder.

15. The fluidized bed of claim 12 further comprising a blower configured to supply gas to said first diffuser board assembly.

16. The fluidized bed of claim 12 further comprising a plenum configured to receive gas from said first diffuser board assembly and supply gas to said second diffuser board assembly.

17. The fluidized bed of claim 12 wherein said second diffuser board assembly is structurally supported by said first diffuser board assembly.

18. The fluidized bed of claim 12 wherein pressure drop in gas flowing through said second diffuser board assembly is related to gas flow rate through it.

19. The fluidized bed of claim 12 wherein said head support section further comprises a plurality of bladders.

20. The fluidized bed of claim 19 further comprising a fluid supply configured to supply fluid to the plurality of bladders.

* * * * *